US007198525B2

(12) United States Patent
Nagamine et al.

(10) Patent No.: US 7,198,525 B2
(45) Date of Patent: Apr. 3, 2007

(54) CONNECTION TERMINAL AND CONNECTOR EQUIPPED THEREWITH

(75) Inventors: Akira Nagamine, Aichi (JP); Megumi Chiyoda, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/315,450

(22) Filed: Dec. 22, 2005

(65) Prior Publication Data

US 2006/0138637 A1 Jun. 29, 2006

(30) Foreign Application Priority Data

Dec. 24, 2004 (JP) ..... 2004-372565

(51) Int. Cl.
*H01R 13/187* (2006.01)

(52) U.S. Cl. ..... 439/843; 439/851; 439/891

(58) Field of Classification Search ..... 439/843, 439/851–852, 891

See application file for complete search history.

(56) References Cited

U.S. PATENT DOCUMENTS

| | | | | |
|---|---|---|---|---|
| 5,238,411 | A | 8/1993 | Jinno et al. | |
| 5,690,517 | A * | 11/1997 | Betsui | 439/839 |
| 5,716,244 | A * | 2/1998 | Egenolf et al. | 439/843 |
| 5,997,363 | A * | 12/1999 | Joly | 439/748 |
| 6,804,122 | B1 | 10/2004 | Wong et al. | |

FOREIGN PATENT DOCUMENTS

| | | |
|---|---|---|
| JP | 11-185898 | 7/1999 |
| JP | 2000-113928 | 4/2000 |
| JP | 2001-6771 | 1/2001 |
| JP | 2003-331965 A | 11/2003 |
| WO | WO-00/74176 | 12/2000 |

OTHER PUBLICATIONS

Patent Abstracts of Japan, Publication No. 11-185898, Publication Date Jul. 9, 1999, 1 page.
Patent Abstracts of Japan, Publication No. 2000-113928, Publication Date Apr. 21, 2000, 1 page.
Patent Abstracts of Japan, Publication No. 2001-006771, Publication Date Jan. 12, 2001, 1 page.
Patent Abstracts of Japan, Publication No. 2003-331965, Publication Date Nov. 21, 2003, 1 page.
European Search Report dated May 10, 2006, Application No. 0529277.9 - 2214; 6 pages.

* cited by examiner

*Primary Examiner*—Truc Nguyen
(74) *Attorney, Agent, or Firm*—Osha Liang LLP

(57) ABSTRACT

The card edge connector includes a housing and a card edge terminal. A plurality of through holes is formed on the housing. A cable is electrically connected to the card edge terminal. The card edge terminal to which the cable is attached by crimping is pressed and inserted into a plurality of through holes on the housing. Conductor areas are provided on the surface and the back of the substrate. The substrate is inserted and fitted into the housing and also held by the holding part of the card edge terminal which is pressed and inserted into the housing and electrically conducted to the conductor areas.

10 Claims, 12 Drawing Sheets

CONNECTION TERMINAL AND CONNECTOR EQUIPPED THEREWITH

TECHNICAL FIELD

The present invention relates to a connection terminal which can electrically connect an electric wiring with conductor areas of a substrate and also relates to a connector equipped therewith.

BACKGROUND ART

There have been so far developed various types of connectors capable of providing an electrical connection depending on use status. A tuning-fork type contact, a bellows type contact, a cantilever-type contact and others have been used inside these connectors as a connection terminal for providing an electrical connection.

For example, in some connectors for connecting a cable with a substrate, one end of a tuning-fork type contact is used to hold the cable and the other end of the tuning-fork type contact is inserted into a through hole of the substrate, thereby making it possible to electrically connect the cable with the substrate.

Japanese Published Unexamined Patent Application No. H11-185898 has disclosed a right angle connector in which contacts can be attached by press-fitting into through holes of a substrate without buckling and connected to the substrate more reliably. Japanese Published Unexamined Patent Application No. 2000-113928 has disclosed a connector in which a locator is used to arrange contacts more accurately and simplify positioning, so that the connector can be assembled more effectively and produced at a lower cost. Further, Japanese Published Unexamined Patent Application No. 2001-6771 has disclosed a connector in which connection terminals can be arranged more accurately and flatness can be improved which is necessary for attaching by press-fitting the connection terminals into a substrate.

SUMMARY OF THE INVENTION

In the connectors disclosed in the above documents, because connection terminals are placed on a substrate, the connectors are made greater in height when actually mounted on the substrate. Further, the manufacturing cost is increased because of attaching by press-fitting connection terminals into through holes formed on the substrate.

Further, the connectors disclosed in the above documents can be used for a prolonged period of time in a desirable environment, for example, in a room. However, in an environment which produces vibration, heat, etc., they cannot be used for a prolonged period of time. For example, resin used for retaining a contact (connection terminal) may be deteriorated due to a heat cycle derived from use or vibration, heat and other factors from the environment. In this instance, a fixed end of the connection terminal retained by resin is set free to make an electrical connection unstable.

Embodiments of the present invention provide a connection terminal which can be made lower in height and can attain an electrical connection without fail even in an environment that produces vibration and heat and also to provide a connector equipped therewith.

A connection terminal in accordance with embodiments of the present invention relates to a connection terminal which connects an electric wiring with a substrate, comprising a crimping part which connects the electric wiring by gripping the conductor part of the electric wiring, a holding part which holds the substrate and also electrically connects conductor areas at a spring contact part which energizes the conductor areas provided at an end part of the substrate and a box part having an approximately rectangular cross section which supports the holding part and electrically communicates with the crimping part, wherein the box part comprises a first face, a second face, a third face, a fourth face, and a fifth face, all formed by bending a single sheet of a planar member. A back surface fifth face is superimposed on a surface of the first face. An end part of the first face is engaged with an aperture formed at an interface between the bent part of the fourth face and that of the fifth face. The spring contact part of the holding part is formed integrally with the first face. The second face and the fourth face communicate with the third face and include a supporting-part retaining rib for retaining a supporting part formed on the third face. The fourth face communicates with the fifth face to retain the fifth face and includes a first spring contact part protection rib for protecting the spring contact part of the first face. The fifth face includes a second spring contact part protection rib for protecting the spring contact part of the first face. The fifth face comprises a bent area that further comprises an insertion/removal preventing part provided by bending one part of the bent area to form a perpendicular face to the bent area.

In some embodiments, the connection terminal of the present invention includes a crimping part, a holding part and a box part. The conductor part of an electric wiring is attached by crimping by the crimping part, conductor areas fixed on an end part of a substrate are energized by a spring contact part of the holding part, thereby providing an electrical connection. Further, the holding part is supported by the box part, and the crimping part is electrically connected with the box part.

In accordance with embodiments of the invention, because the holding part is supported by the box part having the approximately rectangular cross section, strength of the holding part can be improved and also the substrate can be more assuredly retained by the holding part. Further, because the spring contact part of the holding part energizes the conductor areas, the substrate can be electrically connected with the conductor areas more assuredly. In addition, the connection terminal is structured so as to hold the substrate by the holding part, thereby making it possible to partially reduce the height of the connection terminal by taking advantage of the thickness of the substrate. As a result, it can be made lower in height and smaller in size. Further, because the holding part is electrically connected with the crimping part via the box part, it is possible to electrically connect the conductor areas of the substrate with the conductor part of the electric wiring without fail.

Further, because the connection terminal is provided with the holding part and the box part, the fixed end of the connection terminal is not set free and an electrical connection is not made unstable even if resin for retaining the contact (connection terminal) is deteriorated by heat cycle through use or by vibration, heat and other factors coming from a surrounding environment.

In accordance with embodiments of the invention, because an end part of the first face is engaged with a aperture formed at an interface between the fourth face and the fifth face, the box part can be made strong by formations of the first face through the fourth face. Further, because the spring contact part is formed integrally on the first face and the surface of the first face is superimposed on the back of the fifth face, it is possible to protect the spring contact part by the fifth face and also prevent deformation of the spring contact part by an external impact. Because the supporting part which supports a substrate is formed integrally on the third face opposing the first face, it is possible to impart an energizing force of the spring contact part to the substrate without fail. As a result, the substrate can be secured to electrically conduct to an electric wiring via the connection terminal.

In accordance with embodiments of the invention, the supporting part formed on the third face is retained by the supporting-part retaining rib fixed on the second face and the fourth face. Further, the spring contact part is protected by the first spring contact part protection rib provided on the fourth face and the second spring contact part protection rib provided on the fifth face. As a result, the strength of the supporting part can be improved and the spring contact part can be protected, thereby making it possible to impart an energizing force of the spring contact part to the substrate more assuredly.

The connection terminal may be formed by bending a sheet of a member. The thus formed connection terminal is less likely to vary in dimension of members or produce a than in a case where it is formed with a plurality of members, thereby making it possible to improve the strength of the connection terminal itself and consequently improve the strength of the approximately rectangular cross section of the box part. Therefore, strength of the holding part can be kept high. In addition, because the connection terminal is constituted with a sheet of a member, it is possible to reduce the manufacturing cost as compared with a case where a plurality of members are used to manufacture connection terminals.

Because of the presence of the insertion/removal preventing part, the fifth face has the bent area, so that the fifth face no longer has a single sheet configuration, and thereby the rigidity can be improved. In addition, removal from the housing can be prevented.

The first face comprises an approximately oval-shaped contact forming part and a curved part that are formed at a first end thereof, and a rigidity improved part formed at a second end thereof.

In accordance with embodiments of the invention, an electric contact with conductor areas of the substrate is available not at a point but on an area. As a result, electric conduction with the conductor areas can be attained without fail. In addition, the rigidity of the first face is improved, and thereby it is possible to act as a fixed end for the spring structure of the curved part.

The holding part may additionally include a foreign matter prevention part which prevents foreign matter from entering into the spring contact part.

In accordance with embodiments of the invention, foreign matter can be prevented from entering into an elastic part of the spring contact part at the holding part, thereby making it possible to stably impart a predetermined energizing force to the conductor areas of the substrate. As a result, it is possible to electrically connect the conductor areas of the substrate without fail.

The holding part may additionally include a collision avoidance part which prevents collision of the spring contact part with an end part of the substrate when the substrate is inserted and fitted.

In this instance, collision of the spring contact part with the substrate can be prevented when the substrate is inserted and fitted, thereby making it possible to prevent deformation of the spring contact part. It is, therefore, possible to stably impart a predetermined energizing force to the conductor areas of the substrate. Further, it is possible to prevent deformation of the spring contact part, even when the substrate varies in thickness. As a result, the conductor areas of the substrate can be electrically connected more assuredly.

The fifth face may include a spring contact part protection face for protecting the spring contact part by partially bending the fifth face.

In accordance with embodiments of the invention, the spring contact part is protected by the spring contact part protection face. As a result, strength of the supporting part is improved and the spring contact part is protected, thereby making it possible to impart an energizing force of the spring contact part to the substrate more assuredly.

The connector in accordance with another embodiment is a connector that retains a connection terminal connecting and electric wiring with a substrate, the connector comprising a connection terminal and a housing which retains the connection terminal, the connection terminal including a crimping part which connects the electric wiring by gripping a conductor part of the electric wiring, a holding part which holds the substrate between a supporting part and a spring contact part that energizes the conductor areas provided on an end part of the substrate and also electrically connects these conductor areas and a box part having an approximately rectangular cross section which supports the holding part and is electrically communicated with the crimping part, as well as a housing which retains the connection terminal, wherein the box part comprises a first face, a second face, a third face, a fourth face, and a fifth face, all formed by bending a single sheet of a planar member. A back surface fifth face is superimposed on a surface of the first face. An end part of the first face is engaged with an aperture formed at an interface between the bent part of the fourth face and that of the fifth face. The spring contact part of the holding part is formed integrally with the first face. The second face and the fourth face communicate with the third face and include a supporting-part retaining rib for retaining a supporting part formed on the third face. The fourth face communicates with the fifth face to retain the fifth face and includes a first spring contact part protection rib for protecting the spring contact part of the first face. The fifth face includes a second spring contact part protection rib for protecting the spring contact part of the first face. The fifth face comprises a bent area that further comprises an insertion/removal preventing part provided by bending one part of the bent area to form a perpendicular face to the bent area.

The connector of the present invention is provided with a connection terminal and a housing that retains the connection terminal. The connection terminal includes a crimping part, a holding part and a box part. The conductor part of an electric wiring is attached by crimping by the crimping part and an energizing force is imparted to conductor areas fixed on an end part of the substrate by the spring contact part of the holding part to attain an electrical connection. Further, the holding part is supported by a box part, and the crimping part is electrically communicated with the box part.

In accordance with embodiments of the invention, because the connection terminal can retain the substrate by itself and provide an electric conduction, the electric conduction can be secured even when a material of the connector is deteriorated in an environment which produces vibration, heat, etc. As a result, a connector is available which has durability, is resistant to weather, heat and vibration. Further, because a connection terminal is used to hold the substrate, the height of the connector can be reduced by taking advantage of the thickness of the substrate, thereby making it possible to make the connector smaller in size and lower in height.

Further, because the connection terminal is provided with the holding part and the box part, the fixed end of the connection terminal is not set free and an electrical connection is not made unstable even if resin for retaining the contact (connection terminal) is deteriorated by heat cycle through use or by vibration, heat and other factors coming from a surrounding environment.

In accordance with embodiments of the invention, because an end part of the first face is engaged with a aperture formed at an interface between the fourth face and the fifth face, the box part can be made strong by formations of first face through the fourth face. Further, because the spring contact part is formed integrally on the first face and the surface of the first face is superimposed on the back of the fifth face, it is possible to protect the spring contact part by the fifth face and to prevent deformation of the spring contact part by an external impact. Because the supporting part which supports the substrate is formed integrally on the third face opposing the first face, it is possible to impart an energizing force of the spring contact part to the substrate without fail. As a result, the substrate can be secured to electrically conduct to the electric wiring via the connection terminal.

In accordance with embodiments of the invention, the supporting part formed on the third face is retained by the supporting-part retaining rib fixed on the second face and the fourth face. Further, the spring contact part is protected by the first spring contact part protection rib provided on the fourth face and the second spring contact part protection rib provided on the fifth face. As a result, the strength of the supporting part can be improved and the spring contact part can be protected, thereby making it possible to impart an energizing force of the spring contact part to the substrate more assuredly.

Further, the connection terminal may be formed by bending a single sheet of a plane member. The thus formed connection terminal is less likely to vary in dimension of members or produce a than in a case where it is formed with a plurality of members, thereby making it possible to improve the strength of the connection terminal itself and also improve the strength of the approximately rectangular cross section of the box part. Therefore, strength of the holding part can be kept high. In addition, because the connection terminal is constituted with a sheet of a member, it is possible to reduce the manufacturing cost as compared with a case where a plurality of members are used to manufacture connection terminals.

Because of the presence of the insertion/removal preventing part, the fifth face has the bent area, so that the fifth face no longer has a single sheet configuration, and thereby the rigidity can be improved. In addition, removal from the housing can be prevented.

The first face comprises an approximately oval-shaped contact forming part and a curved part that are formed at a first end thereof, and a rigidity improved part formed at a second end thereof.

In accordance with embodiments of the invention, an electric contact with conductor areas of the substrate is available not at a point but on an area. As a result, electric conduction with the conductor areas can be attained without fail. In addition, the rigidity of the first face is improved, and thereby it is possible to act as a fixed end for the spring structure of the curved part.

The holding part may additionally include a foreign matter prevention part which prevents foreign matter from entering into the spring contact part.

In accordance with embodiments of the invention, foreign matter can be prevented from entering into an elastic part of the spring contact part at the holding part, thereby making it possible to stably impart a predetermined energizing force to the conductor areas of the substrate. As a result, it is possible to electrically connect the conductor areas of the substrate without fail.

The holding part may additionally include a collision avoidance part for preventing collision of the spring contact part with an end part of the substrate when the substrate is inserted and fitted.

In accordance with embodiments of the invention, collision of the spring contact part with the substrate can be prevented when the substrate is inserted and fitted, thereby making it possible to prevent deformation of the spring contact part. It is, therefore, possible to stably impart a predetermined energizing force to the conductor areas of the substrate. Further, it is possible to prevent deformation of the spring contact part, even when the substrate varies in thickness. As a result, the conductor areas of the substrate can be electrically connected more assuredly.

The fifth face may include a spring contact part protection face for protecting the spring contact part by partially bending the fifth face.

In accordance with embodiments of the invention, the spring contact part is protected by the spring contact part protection face. As a result, strength of the supporting part is improved and the spring contact part is protected, thereby making it possible to impart an energizing force of the spring contact part to the substrate more assuredly.

DESCRIPTION OF THE PREFERRED EMBODIMENTS

Hereinafter, an explanation will be made for embodiments of the present invention. In these embodiments, an explanation will be made for a case where a card edge connector is used as an example of connectors, and an explanation will be made for a case where a card edge terminal inserted and fitted into a card edge connector is used as a connection terminal.

(Embodiment 1)

Figure 1:
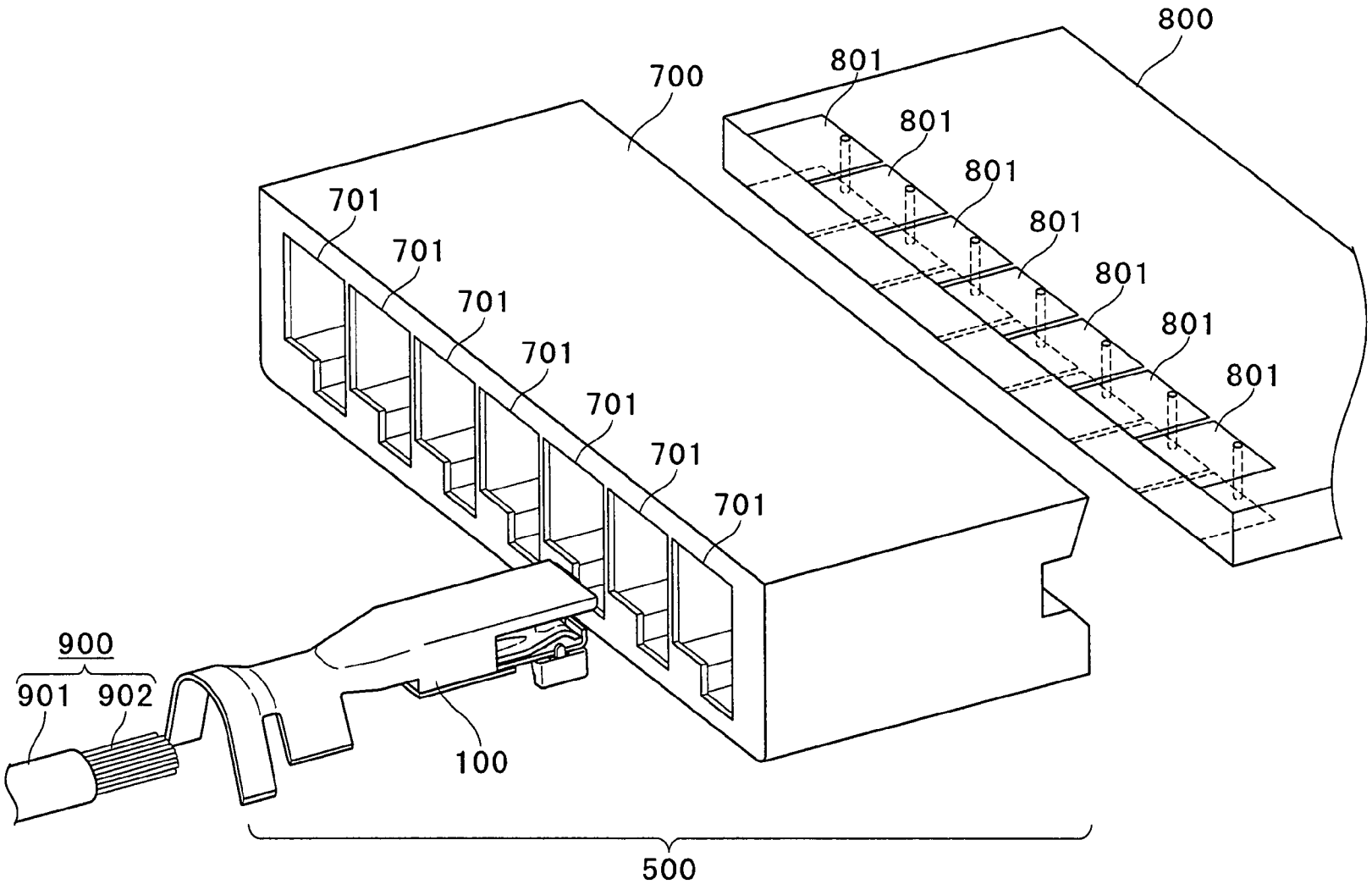
FIG. 1 is an assembly view showing appearances of the card edge connector, the electric wiring and the substrate related to the embodiment 1 of the present invention.

FIG. 1 is an assembly drawing showing appearances of a card edge connector 500, a substrate 800 and a cable 900 of the embodiment 1 of the present invention.

As shown in FIG. 1, the card edge connector 500 includes a housing 700 and a card edge terminal 100. The housing 700 is provided with a plurality of through holes 701.

Further, although a single card edge terminal 100 is shown in FIG. 1, it is shown, with other card edge terminals 100 omitted, for a simplified explanation. A plurality of card edge terminals 100 is actually inserted in the number corresponding to a plurality of through holes 701 of the housing 700.

The card edge terminal 100 is electrically connected to the cable 900. A conductor 902 from which a coated part 901 of the cable 900 is removed is provided at an edge of the cable 900. As will be explained later, the coated part 901 of the cable 900 and the conductor 902 are attached by crimping by the crimping part 400 of the card edge terminal 100. The card edge terminal 100 to which the cable 900 is attached by crimping is pressed and inserted into a plurality of through holes 701 on the housing 700.

Conductor areas 801 are provided on the surface and the back of the substrate 800. The conductor areas 801 provided on the surface and the back are electrically conducted via through holes. The substrate 800 is inserted and fitted into the housing 700. In this instance, the substrate 800 is held by the holding part 200 (not illustrated) of the card edge terminal 100 pressed and inserted into the housing 700 and electrically conducted to the conductor areas 801.

As a result, the conductor 902 of the cable 900 is electrically conducted to the conductor areas 801 of the substrate 800 via the card edge connector 500.

Figure 2:
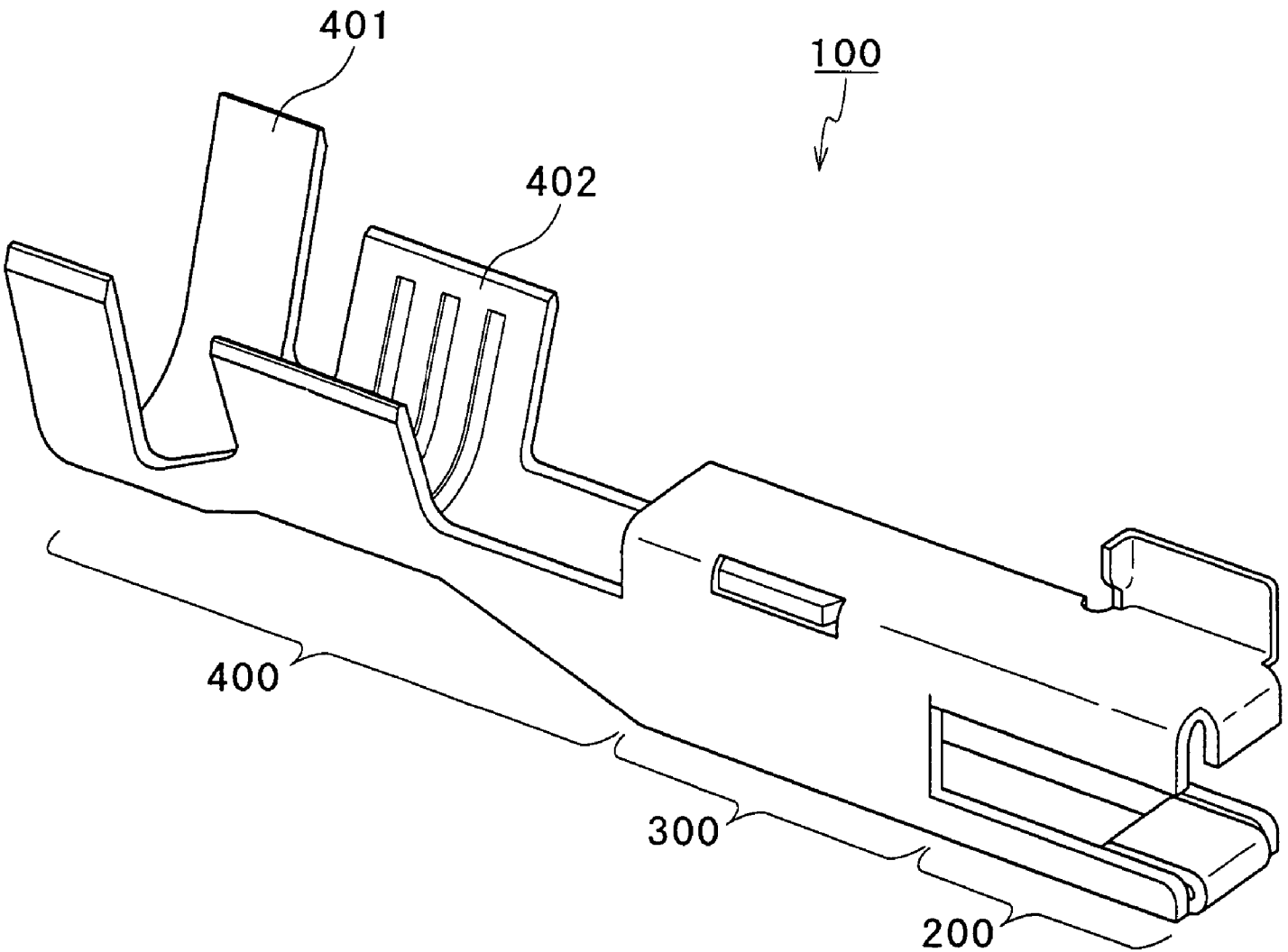
FIG. 2 is a perspective view showing an appearance of the card edge terminal.

FIG. 2 is a perspective view showing an appearance of the card edge terminal 100.

As shown in FIG. 2, the card edge terminal 100 mainly includes a holding part 200, a box part 300 and a crimping part 400.

The crimping part 400 includes a first crimping part 401 and a second crimping part 402. The first crimping part 401 can prevent a removable insertion of a cable 900 by attaching by crimping the coated part 901 of the cable 900. The second crimping part 402 electrically connects the card edge terminal 100 with the cable 900 by attaching by crimping the conductor 902 of the cable 900.

Next, the box part 300 has an approximately rectangular cross-section. Further, the holding part 200 formed in communication with the box part 300 is structured so as to retain the substrate 800. The box part 300 and the holding part 200 will be explained later for a detailed configuration.

The card edge terminal 100 shown in FIG. 2 is formed with a single sheet of an electrically conductive metal member. An explanation will be made for a development view of the card edge terminal 100 and then for the manufacturing process.

Figure 3:
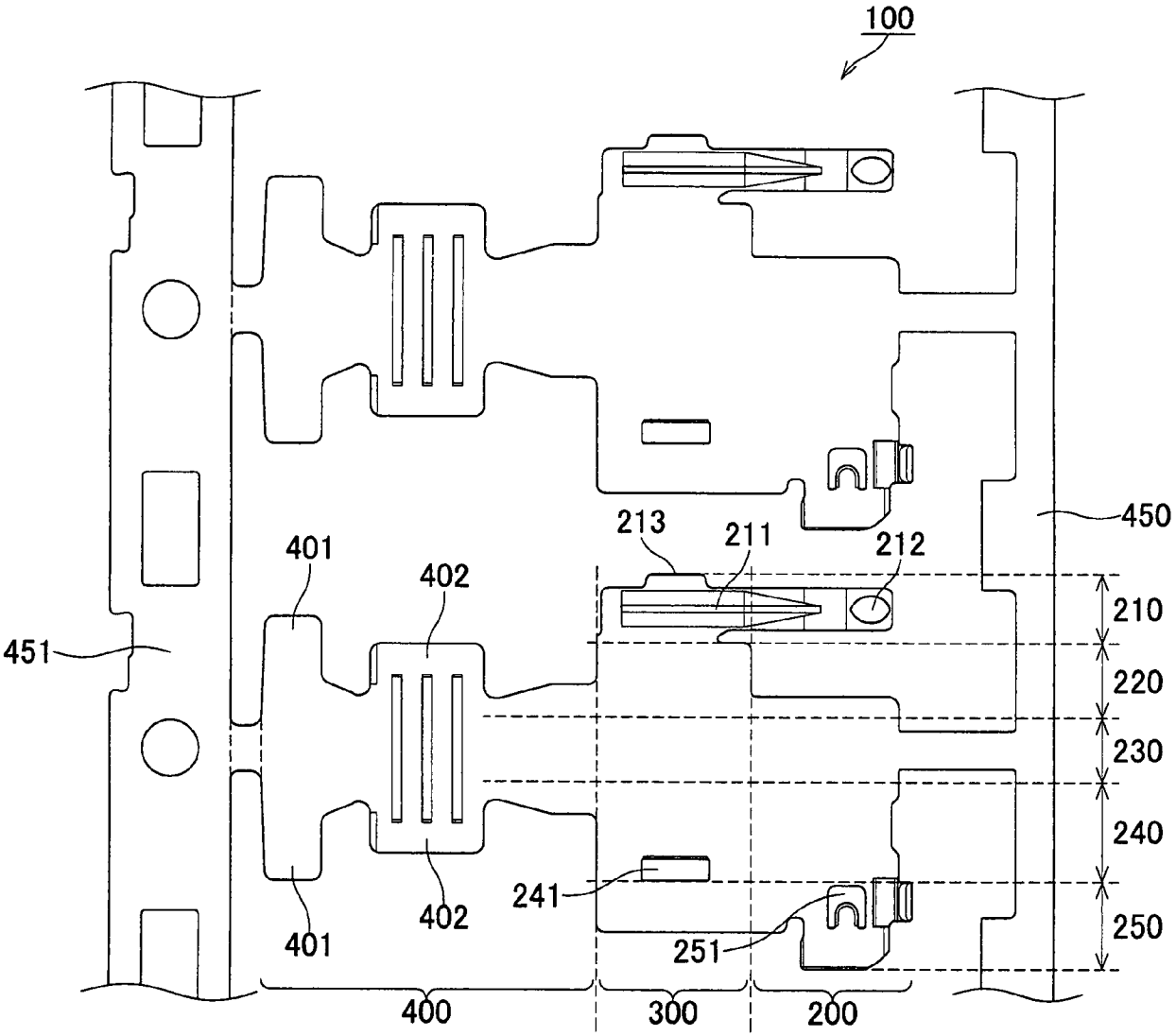
FIG. 3 is a development view of the card edge terminal of FIG. 2.

FIG. 3 is a development view of the card edge terminal 100 shown in FIG. 2.

As shown in FIG. 3, the card edge terminal 100 is formed by stamping out a single sheet of a metal member.

First, as shown in FIG. 3, a plurality of card edge terminals 100 are stamped out from a sheet of a metal member by press working (first process) in a state retained by joint members 450 and 451.

A plurality of the thus stamped card edge terminals 100 include a part which forms a holding part 200, a box part 300 and a crimping part 400.

Hereinafter, an explanation will be made for metal plate members corresponding to the card edge terminal 100, the holding part 200 and the box part 300 shown in FIG. 3 by dividing them into five pieces, namely, a first face 210, a second face 220, a third face 230, a fourth face 240 and a fifth face 250. These faces of five-divided pieces are equivalent to faces forming the box part 300 having a rectangular cross section on the card edge terminal 100 to be explained later.

Further, as shown in FIG. 3, a rigidity improved part 211, a contact forming part 212, a locking part 213 and a curved part 215 (not illustrated) are formed on the first face 210 at the same time by the press working (first process). The rigidity improved part 211, the contact forming part 212, the locking part 213 and the curved part 215 on the first face 210 will be explained later for a detailed configuration.

Further, a rectangular hole 241 is formed on the fourth face 240 at the same time by the press working (first process) Next, a through hole 251 is formed on the fifth face 250 at the same time by the press working (first process).

The crimping part 400 shown in FIG. 3 is provided with the first crimping part 401 and the second crimping part 402. As explained above, the first crimping part 401 is formed so that the coated part 901 of the cable 900 can be attached by crimping, and the second crimping part 402 is formed so that the conductor 902 of the cable 900 can be attached by crimping.

Next, an explanation will be made for the manufacturing process of the card edge terminal 100 shown in FIG. 3 by referring to FIG. 4 through FIG. 7.

FIG. 4 through FIG. 7 is flow sheets showing one example of the manufacturing process of the card edge terminal 100. Items from (a) to (g) in FIG. 4 through FIG. 7 show manufacturing processes covering bending or cutting of the card edge terminal 100.

Figure 4:
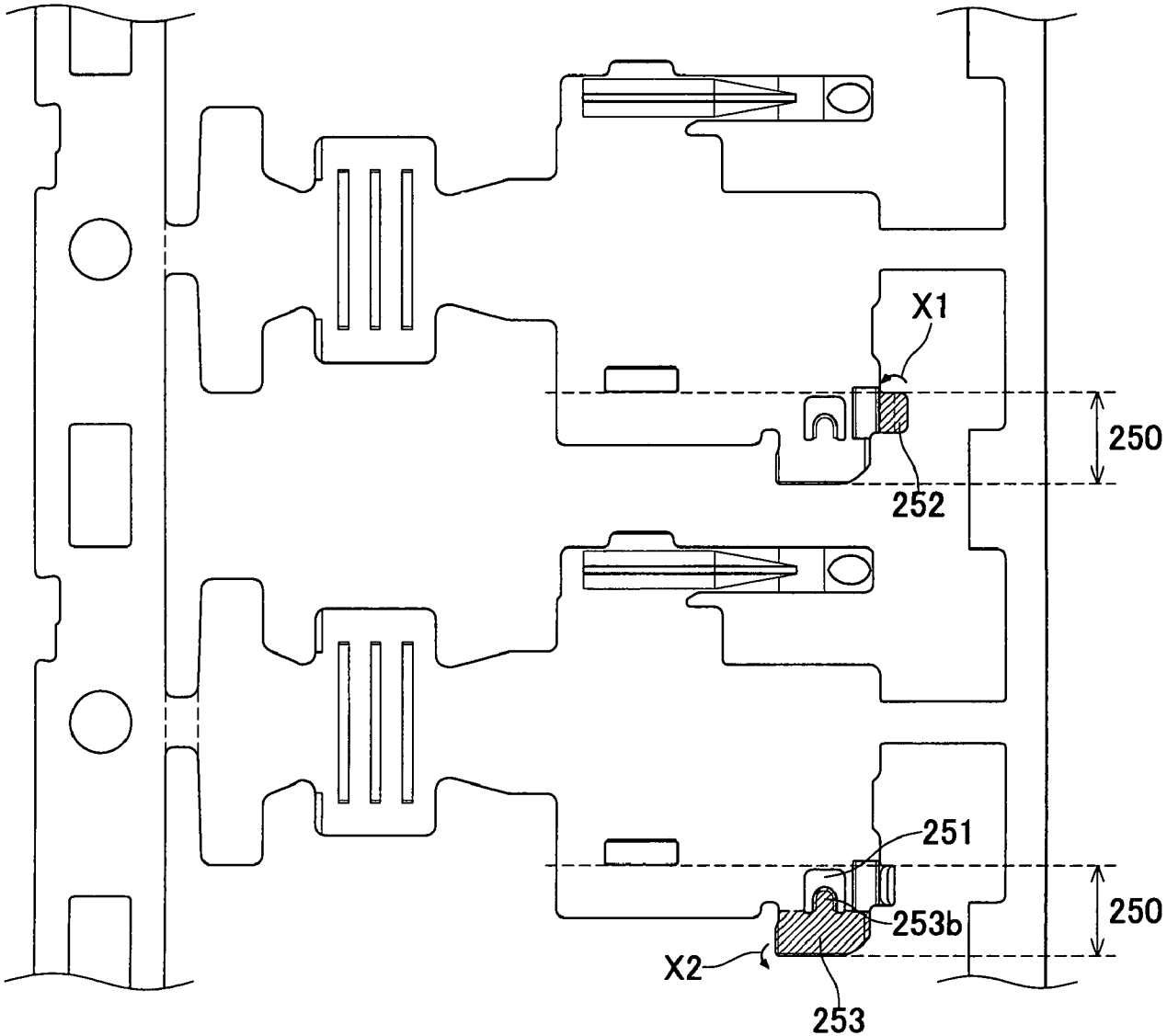
FIG. 4 is a flow sheet showing one example of the manufacturing process of the card edge terminal.

At first, as shown in FIG. 4(*a*), a collision prevention part 252, which is an area of the fifth face 250 of the card edge terminal 100 is bent toward the direction shown by the arrow x 1 in the drawing.

Next, as shown in FIG. 4(*b*), a reverse insertion preventing part 253 which is an area of the fifth face 250 of the card edge terminal 100 is bent toward the direction shown by the arrow x 2 in the drawing.

In this instance, since the through hole 251 is stamped out so as to partially form a protrusion in place of a rectangular form, the reverse insertion preventing part 253 is provided with a foreign matter prevention part 253*b*.

Figure 5:
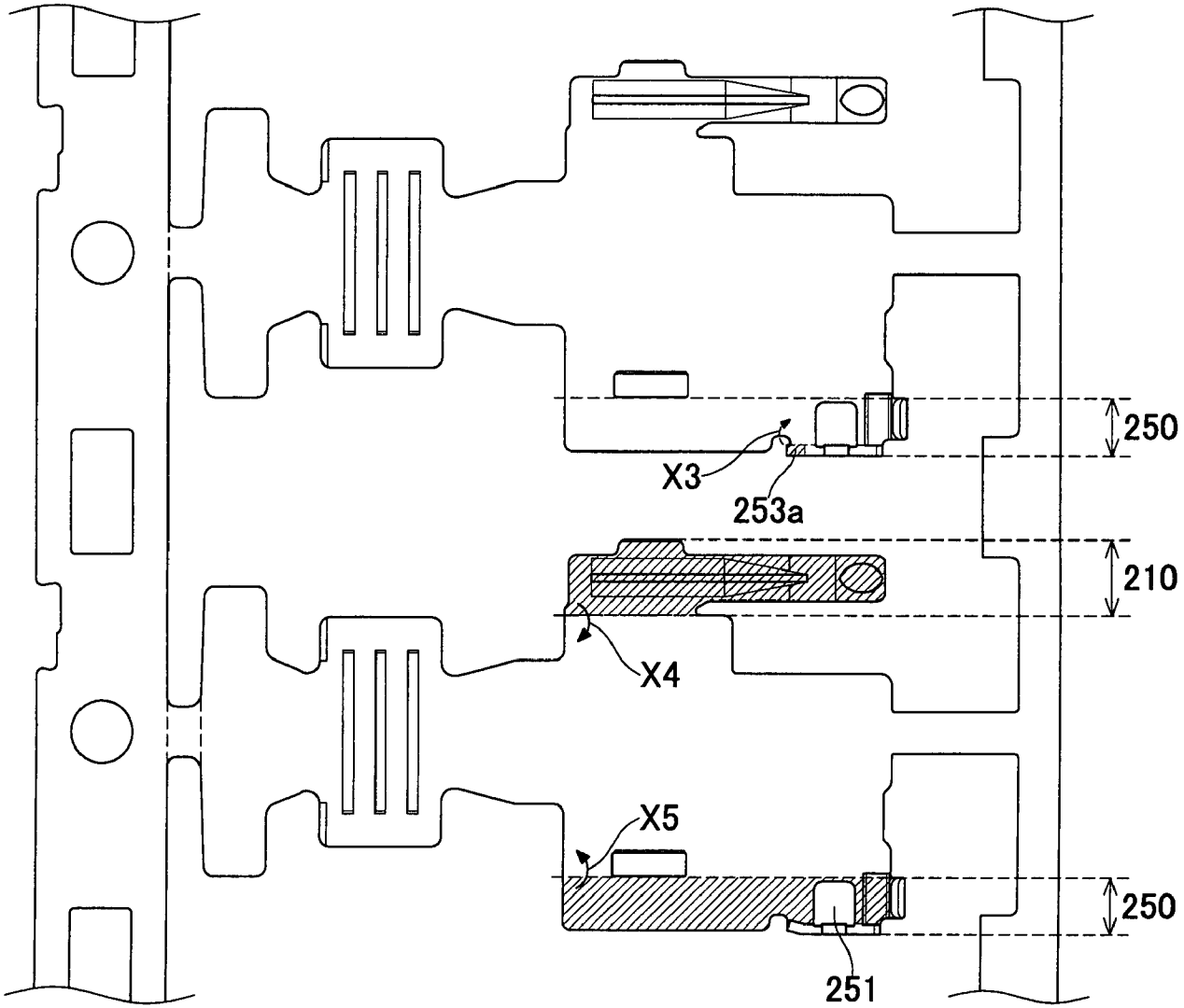
FIG. 5 is a flow sheet showing one example of the manufacturing process of the card edge terminal.

Next, as shown in FIG. 5(*c*), a strength supporting part 253*a* which is another area of the bent reverse insertion preventing part 253 of the fifth face 250 of the card edge terminal 100 is bent toward the direction shown by the arrow x 3 in the drawing. Since the reverse insertion preventing part 253 is not in a single sheet configuration due to bending of the strength supporting part 253*a*, strength of the reverse insertion preventing part 253 is improved. Further, the reverse insertion preventing part 253 and the strength supporting part 253*a* can prevent the removal from the housing 700.

Next, as shown in FIG. 5(*d*), a whole part of the first face 210 of the card edge terminal 100 is bent toward the direction shown by the arrow x 4 in the drawing, and a whole part of the fifth face is bent toward the direction shown by the arrow x 5 in the drawing.

Figure 6:
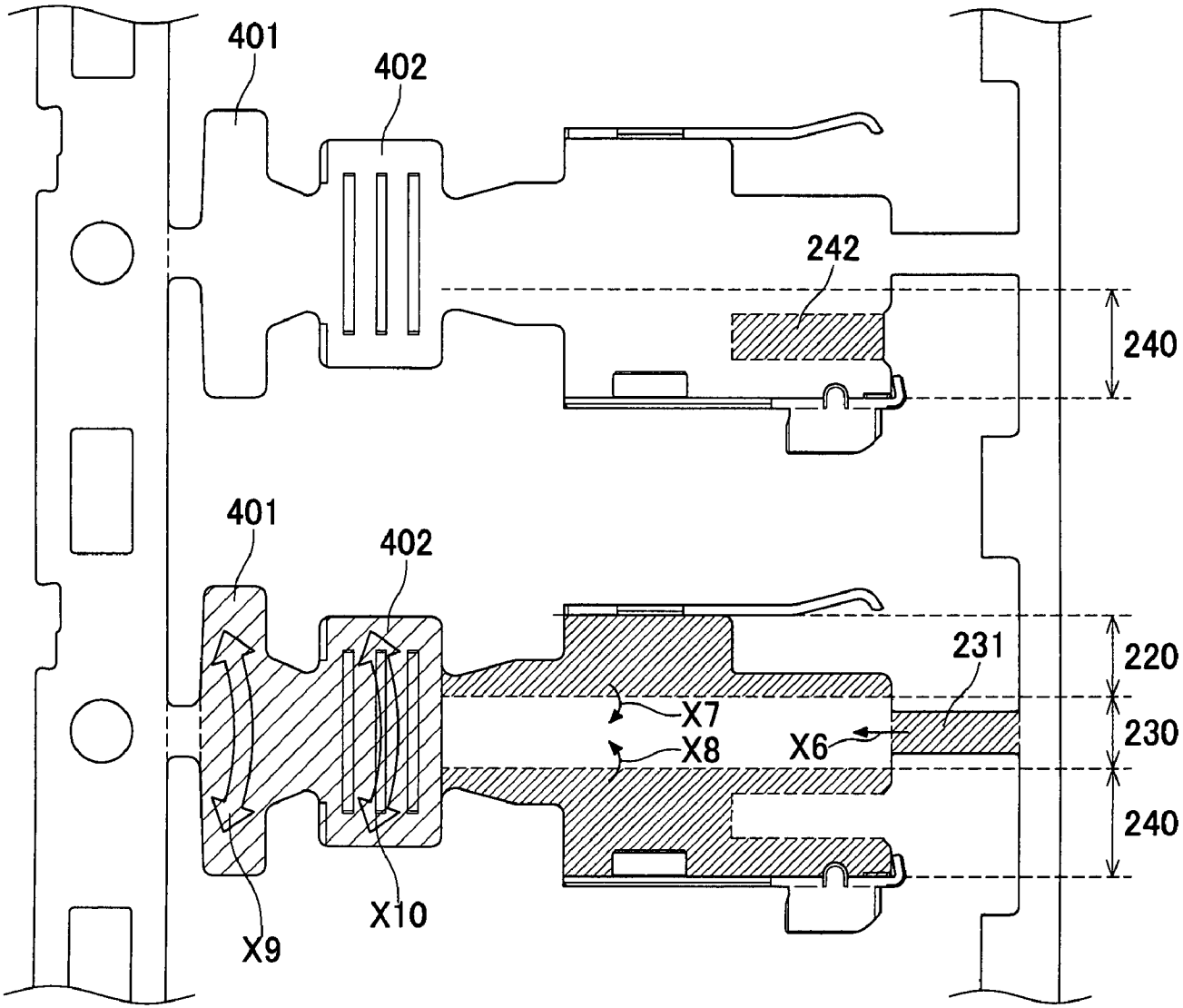
FIG. 6 is a flow sheet showing one example of the manufacturing process of the card edge terminal.

Next, as shown in FIG. 6(*e*), an area 242 of the fourth face 240 of the card edge terminal 100 is stamped out.

Next, as shown in FIG. 6(*f*), the supporting part 231 which is an area of the third face 230 of the card edge terminal 100 is cut away from a joint member 450 and bent toward the direction shown by the arrow x 6. Thereafter, the second face 220 and the fourth face 240 are bent respectively toward the directions shown by the arrow x 7 and the arrow x 8. The first crimping part 401 and the second crimping part 402 of the crimping part 400 are bent respectively toward the directions shown by the arrow x 9 and the arrow x 10.

Figure 7:
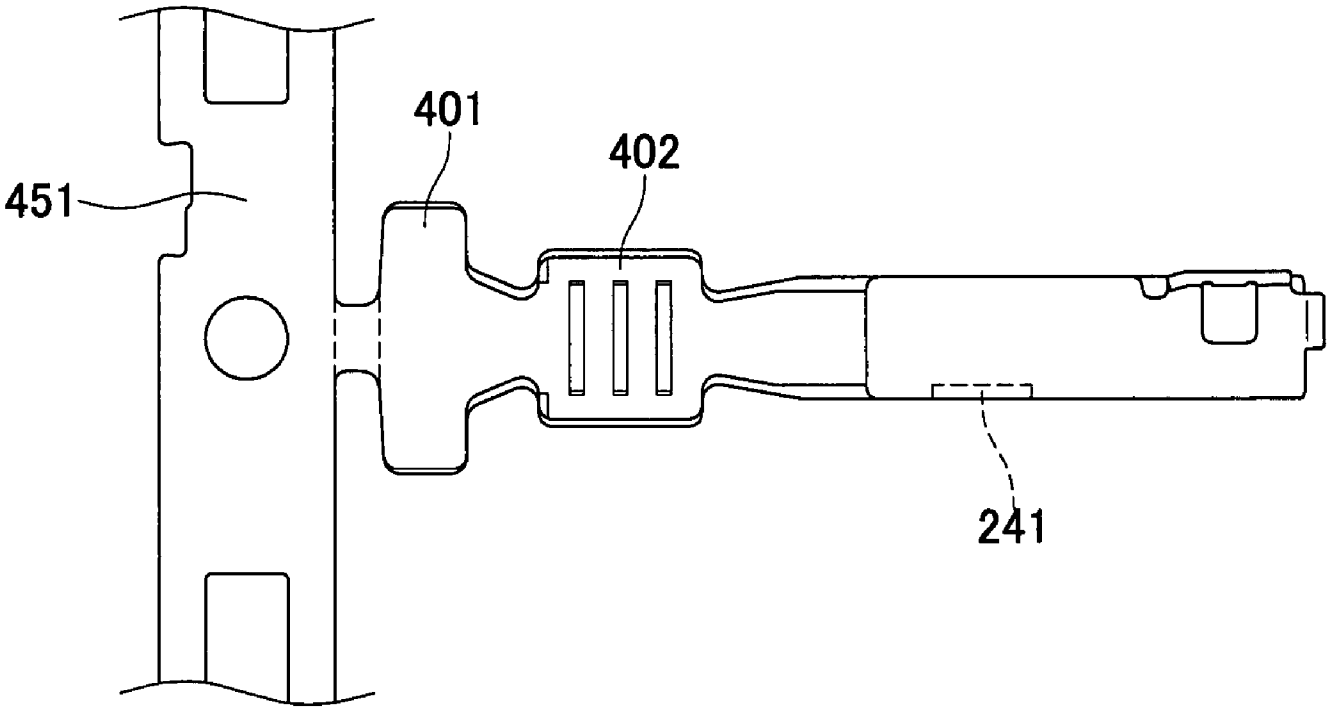
FIG. 7 is a flow sheet showing one example of the manufacturing process of the card edge terminal.

Finally, as shown in FIG. 7(*g*), the card edge terminal 100 shown in FIG. 2 is formed in a state connected to the joint member 451.

The card edge terminal 100 is formed from a single sheet of a metal member through the above-described processes.

Figure 8A:
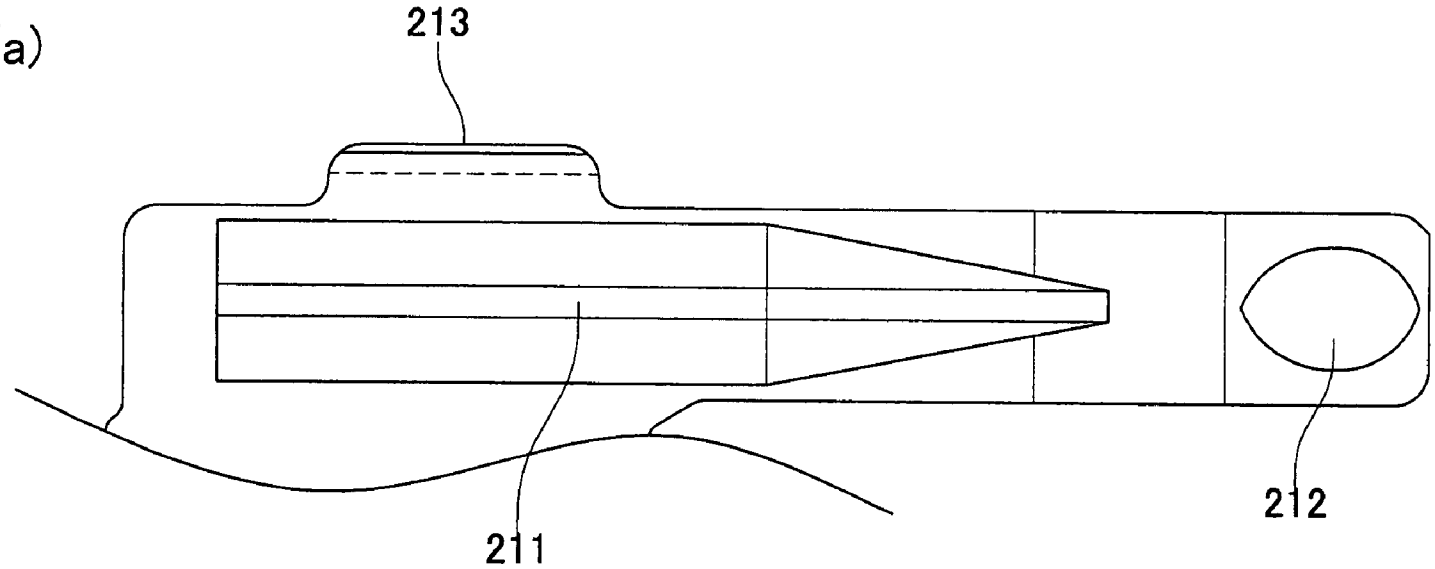
FIG. 8 is a diagrammatic appearance view showing the details of the first face.
Figure 8B:
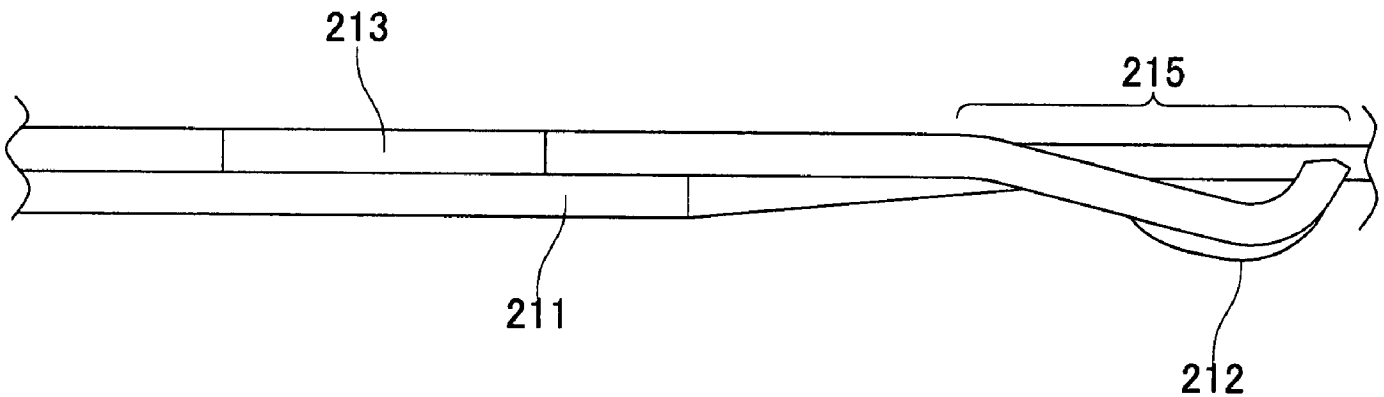

Next, an explanation will be made regarding the details of the first face 210. FIG. 8 is a diagrammatic external view showing the details of the first face 210. (a) shows a plain view of the first face 210, and (b) shows a side view of the first face 210.

As shown in FIGS. 8(*a*) and (*b*), an approximately oval-shaped contact forming part 212 and a curved part 215 are formed at an edge part of the first face 210 by press working (first process).

As shown in FIG. 8(*b*), a whole part of the edge part of the first face 210 at the curved part 215 is once curved downward and formed so that the edge part of the first face 210 can point upward. The curved part 215 is provided with a spring structure due to this configuration.

In addition, a contact forming part 212 is formed at the lowest part where the edge part of the first face 210 is curved. Since the contact forming part 212 is in an approximately oval shape, it is not available in a configuration where one point projects outward but in a configuration where a certain area projects outward. Therefore, an electric contact with conductor areas 801 of the substrate 800 to be explained later is available not at a point but on an area. As a result, the electric conduction with the conductor areas 801 can be attained without fail.

A rigidity improved part 211 is also formed by press working (first process) at the center of the first face 210. The rigidity improved part 211 is formed linearly in a concave form, thereby improving the rigidity of the first face 210. The rigidity improved part 211 acts as a fixed end for the spring structure of the curved part 215.

A locking part 213 is formed at one end part of the first face 210. Next, an explanation will be made for the function of the locking part 213.

Figure 9:
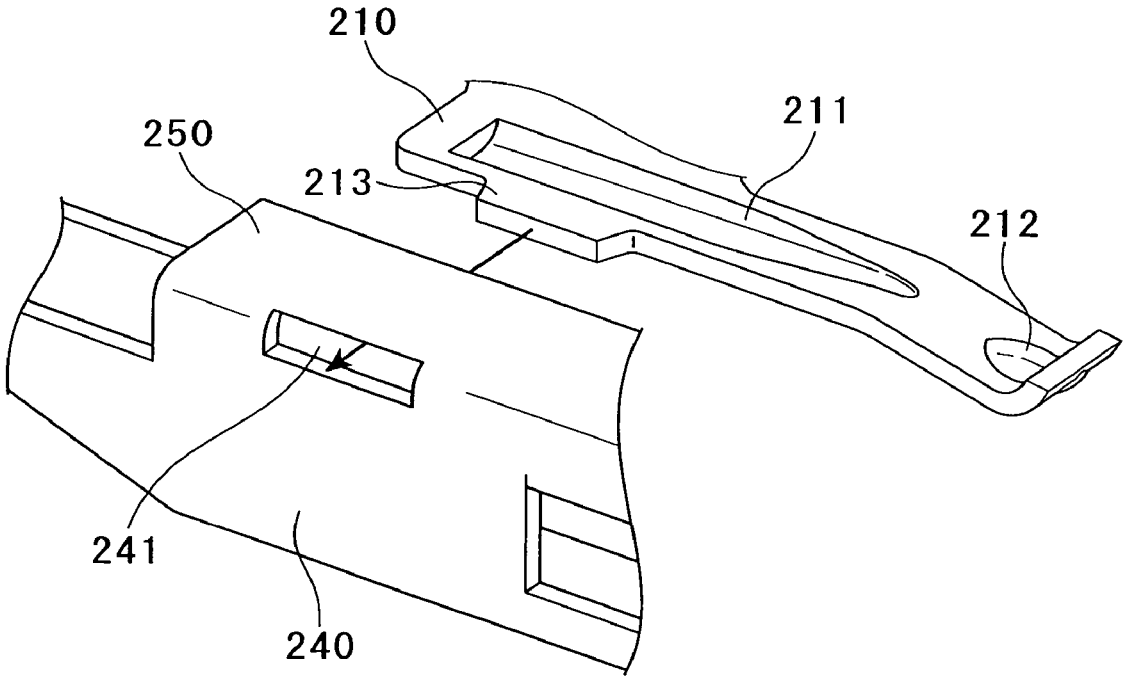
FIG. 9 is a view explaining the action of the first face having a rib configuration.
Figure 10:
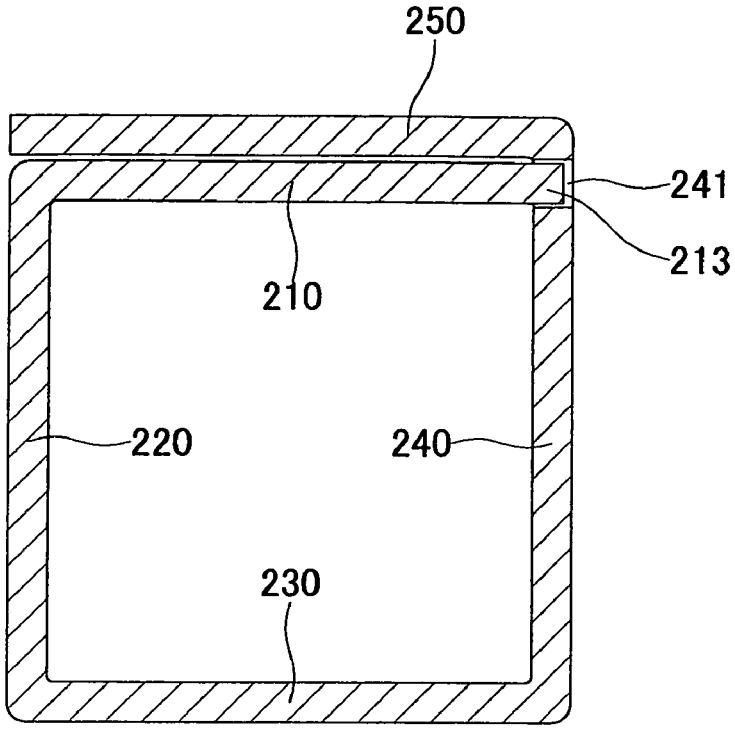
FIG. 10 is a diagrammatic cross-sectional view showing a state that the first face having a rib configuration is fitted into a rectangular-shaped hole.
Figure 10:
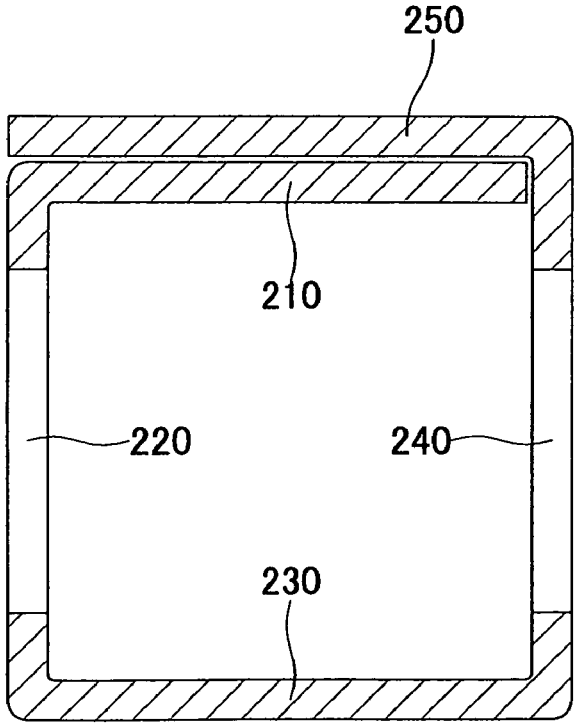

FIG. 9 is a view for explaining the function of the locking part 213 of the first face 210, and FIG. 10 is a diagrammatic cross-sectional view showing a state that the locking part 213 of first face 210 is fitted into the rectangular hole 241. Further, FIG. 10(*a*) shows the diagrammatic cross section of the box part 300, and FIG. 10(*b*) shows the diagrammatic cross section of the holding part 200.

As shown in FIG. 9, the locking part 213 of the first face 210 is formed in a tapered shape so that it can be inserted and fitted into the rectangular hole 241. In the above-described process in FIG. 6(*f*), the locking part 213 of the first face 210 is inserted and fitted into the rectangular hole 241 formed between the fourth face 240 and the fifth face 250.

As a result, as shown in FIG. 10(*a*), the first face 210 is super imposed vertically on the fifth face 250, and the locking part 213 of the first face 210 is retained by the rectangular hole 241. Further, an approximately rectangular shape is formed by the first face 210, the second face 220, the third face 230 and the fourth face 240 on a box part 300.

This box part 300 is provided with a rectangular cross section which is strong and free of any clearance, since the first face 210 and the fourth face 240 are fitted to each other by the locking part 213 and the rectangular hole 241.

As shown in FIG. 10(*b*), a rib configuration 220*a* is formed at a part of the second face 220 adjacent to the first face 210 in the holding part 200 as well, a supporting-part retaining rib 220*b* is formed at a part of the second face 220 adjacent to third face 230, a supporting-part retaining rib 240*a* is formed at a part of the fourth face 240 adjacent to the third face, and a first spring contact part protection rib 240*b* is formed at a part of the fourth face 240 adjacent to the first face 210. In this instance, since the cross section of the holding part 200 is approximately rectangular, strength of the holding part 200 can be improved.

Further, since the first spring contact part protection rib 240*b* is formed so as to protect the first face 210, there is no direct force applied outside to the spring structure of the curved part 215 on the first face 210. Therefore, the curved part 215 is not deformed and an energizing force from the spring structure can be kept. Further, an energizing force at the curved part 215 of the first face 210 can be supported assuredly by the rigidity improved part 211, the locking part 213 and the rectangular hole 241 on the first face 210.

Figure 11:
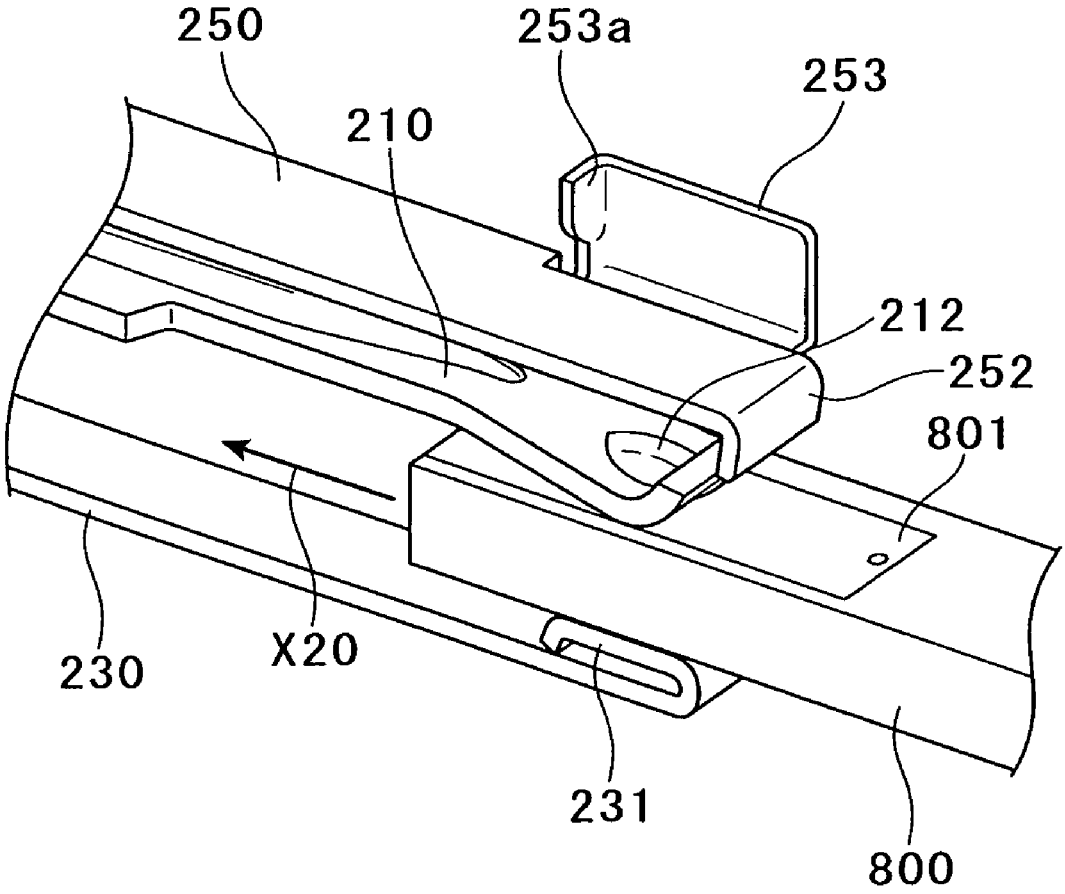
FIG. 11 is a diagrammatic perspective view showing a state that the substrate is inserted and fitted into the holding part of the card edge terminal.

Next, FIG. 11 is a diagrammatic perspective view showing a state that a substrate 800 is inserted and fitted into a holding part 200 of a card edge terminal 100. The perspective view of the card edge terminal 100 shown in FIG. 11 is described, at an upside down position for a simplified explanation, as compared with the drawing shown in FIG. 1.

As shown in FIG. 11, at first, the substrate 800 is inserted and fitted into the holding part 200 of the card edge terminal 100 in the direction shown by the arrow x 20. In this instance, the curved part 215 is protected by the collision prevention part 252 of the fifth face 250 so that an edge of the substrate 800 does not collide directly with the curved part 215 of the first face 210.

Further, the spring-structured curved part 215 of the first face 210 is externally wrapped by the fifth face 250. Therefore, the substrate 800 will not directly collide with the curved part 215 or deform the curved part 215.

The substrate 800 is held between the supporting part 231 of the third face 230 and the curved part 215 of the first face 210. Further, the supporting part 231 is a fixing member and supports the substrate 800 when an energizing force is worked from the curved part 215 which presses the substrate 800 to the supporting part 231.

In the present embodiment, the supporting part 231 is a fixing member. However, the present invention shall not be restricted thereto and may include any other appropriate fixing members. For example, it may be structured so that a spring structure is given to the supporting member 231.

Figure 12:
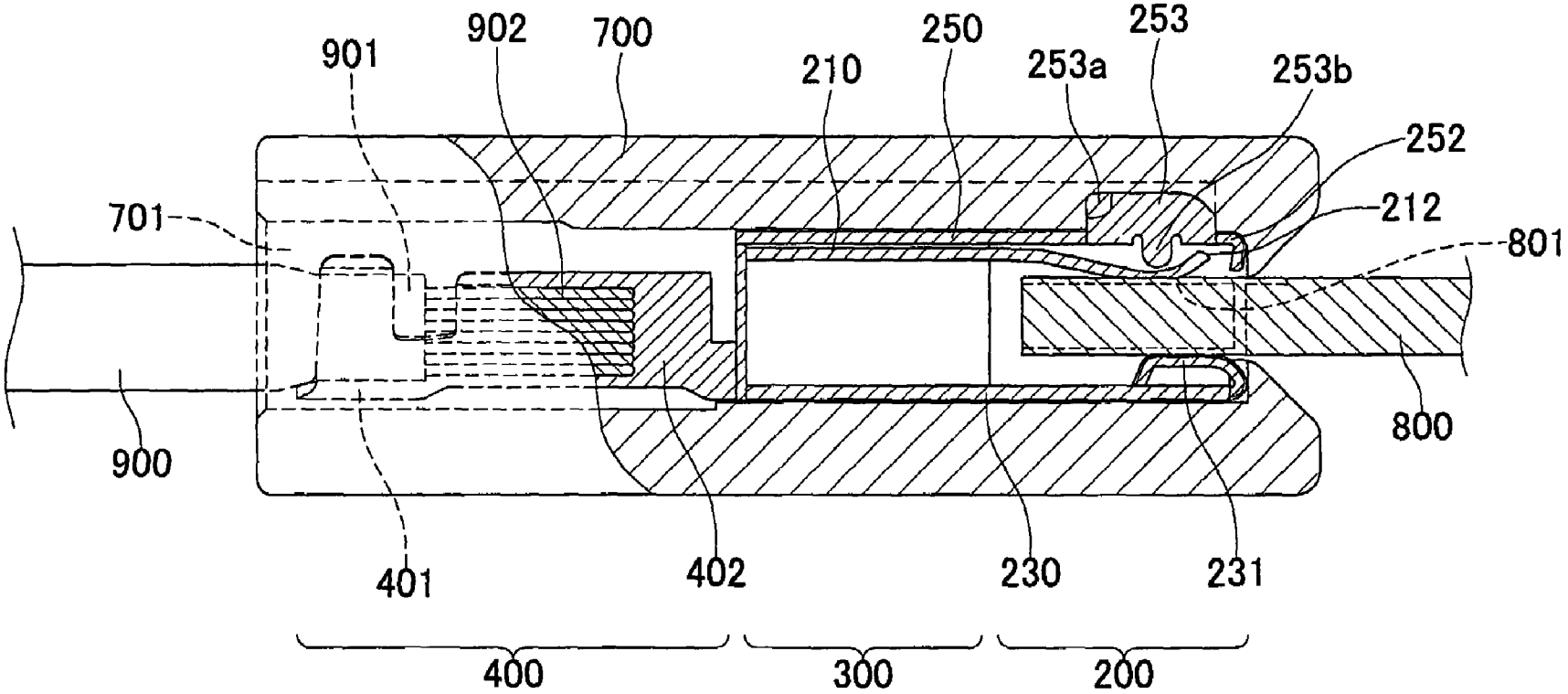
FIG. 12 is a diagrammatic cross-sectional view showing a state that the cable is attached by crimping to the card edge terminal and inserted into the housing and the substrate is also fitted thereinto.

FIG. 12 is a diagrammatic cross-sectional view showing a state that the cable 900 is attached by crimping to the card edge terminal 100 and inserted into the housing 700 and a substrate 800 is also fitted.

As shown in FIG. 12, a coated part 901 is attached by crimping by the first crimping part 401 of the crimping part 400 at the card edge terminal 100, and a conductor 902 is attached by crimping by the second crimping part.

The card edge terminal 100 to which the cable 900 attached by crimping is inserted and fitted into a through hole 701 of the housing 700. In this instance, an edge of a reverse insertion preventing part 253 of the fifth face 250 is pressed and inserted into the housing 700. The reverse insertion preventing part 253 prevents a reverse insertion of the card edge terminal 100 and the housing 700, thereby fixing the card edge terminal 100 with the housing 700.

Next, the substrate 800 is inserted and fitted into the holding part 200 of the housing 700. The substrate 800 is held between the curved part 215 of the first face 210 and the supporting part 231 of the third face 230 at the holding part 200 retained by the box part 300. Further, as described above, a direct collision of the curved part 215 with an edge of the substrate 800 can be prevented by a collision prevention part 252.

Entrance of foreign matter into a space below the curved part 215 can be prevented by the foreign matter prevention part 253*b* of the reverse insertion preventing part 253 on the fifth face 250, thereby making it possible to secure the space so that the curved part 215 can be bent downward. In this instance, since an energizing force of the curved part 215 is protected, it is possible to stably impart a predetermined energizing force to the conductor areas 801 of the substrate 800 from the supporting part 231 and the curved part 215. As a result, the conductor areas 801 of the substrate 800 can be electrically connected without fail.

Therefore, in the card edge terminal 100 of the present invention, since the holding part 200 can be supported by the box part 300 having an approximately rectangular cross section, it is possible to improve the strength of the holding part 200. Further, since the locking part 213 of the first face 210 at the box part 300 is engaged with rectangular holes 241 on the fourth face 240 and the fifth face 250, the approximately rectangular cross section formed by the first face 210 through the fourth face 240 can be made strong. The third face 230 is also supported by supporting-part retaining ribs 220*b* and 240*a* provided on the second face 220 and the fourth face 240. As a result, the substrate 800 can be retained more assuredly by the holding part 200.

Further, since the card edge terminal 100 is made from a single sheet of a metal member, it is possible to improve the strength of the card edge terminal 100 itself and also the strength of the box part 300 having an approximately rectangular cross section. It is also possible to reduce the manufacturing cost, compared with a case where a plurality of members is used to manufacture the card edge terminal 100.

An energizing force works on the conductor areas 801 from the curved part 215 of the holding part 200 and the contact forming part 212 and also the holding part 200 is electrically connected with the crimping part 400 via the box part 300, thereby making it possible to electrically connect the conductor areas 801 of the substrate 800 with the conductor 902 of the cable 900 without fail.

Further, the card edge terminal 100 is structured so as to hold the substrate 800 by the holding part 200, thereby making it possible to partially reduce the height of the card edge terminal 100 by taking advantage of the thickness of the substrate 800. Therefore, the card edge connector 500 can be made lower in height and smaller in size.

In addition, the curved part 215 and the contact forming part 212 are formed integrally into the first face 210, and the surface of the first face 210 is superimposed on the back of the fifth face 250. The curved part 215 is protected by the first spring contact part protection rib 240*b* of the fourth face 240, while the contact forming part 212 is protected by the fifth face 250. Further, the supporting part 231 is formed integrally into the third face 230 opposing the first face 210, thereby making it possible to prevent the curved part 215 and the contact forming part 212 from being deformed by an external impact and also to impart to the substrate 800 an energizing force of the curved part 215 and of the contact forming part 212 without fail.

Further, since the card edge terminal 100 can hold the substrate 800 by itself and provide an electric conduction, it will not lose the electric conduction and can provide an electrical connection without fail even when the material of the card edge connector 500 is deteriorated by environmental factors such as vibration and heat. As a result, the card edge connector 500 is available, which has high durability, is resistant to weather, heat and vibration.

Further, since the height of the card edge terminal 100 can be reduced by taking advantage of the thickness of the substrate 800, it is possible to make the card edge connector 500 itself smaller in size and lower in height.

In the above-described embodiment 1, the substrate 800 is equivalent to the substrate, the cable 900 is equivalent to the electric wiring, the card edge terminal 100 is equivalent to the connection terminal, the conductor 902 is equivalent to the conductor part, the crimping part 400 is equivalent to the crimping part, the holding part 200 is equivalent to the holding part, the conductor areas 801 are equivalent to the conductor areas, the curved part 215 and the contact forming part 212 are equivalent to the spring contact part, the box part 300 is equivalent to the box part, the foreign matter prevention part 253*b* is equivalent to the foreign matter prevention part, the collision prevention part 252 is equivalent to the collision avoidance part and the spring contact part protection face, the first face 210 is equivalent to the first face, the second face 220 is equivalent to the second face, the third face 230 is equivalent to the third face, the fourth face 240 is equivalent to the fourth face, the fifth face 250 is equivalent to the fifth face, the rectangular hole 241 is equivalent to the clearance, the locking part 213 is equivalent to an end part of the first face, the supporting part 231 is equivalent to the supporting part, the supporting-part retaining rib 220*b* and the supporting-part retaining rib 240*a* are equivalent to the supporting-part retaining ribs, the first spring contact part protection rib 240*b* is equivalent to the first spring contact part protection rib, the reverse insertion preventing part 253 is equivalent to the second spring contact part protection rib, and the housing 700 is equivalent to the housing.

Further, the card edge terminal is formed from a single sheet of a metal plate having an electric conduction. However, the present invention shall not be restricted thereto and may include any given metal or metals made by any given number of metals, etc.

The present invention has been described in the above-described preferable embodiment. However, the present invention shall not be restricted thereto alone and it is apparent that the present invention may be applicable to any other embodiments, without deviating from the spirit and scope of the present invention. Further, the present embodiment has described the actions and effects when constituted according to the present invention. However, these actions and effects are only one example and shall not be construed to restrict the present invention.

What is claimed is:

1. A connection terminal which connects an electric wiring with a substrate, comprising;

a crimping part for connecting the electric wiring by griping a conductor part of the electric wiring;

a holding part which holds the substrate between a supporting part and a spring contact part that energizes the conductor areas fixed at an end part of the substrate and also electrically connects the conductor areas and a box part having an approximately rectangular cross section which supports the holding part and also electrically communicates with the crimping part, wherein the box part comprises;

a first face, a second face, a third face, a fourth face, and a fifth face, all formed by bending a single sheet of a planar member;

wherein a back surface of the fifth face is superimposed on a surface of the first face, wherein an end part of the first face is engaged with an aperture formed at an interface between the bent part of the fourth face and that of the fifth face, wherein the spring contact part of the holding part is formed integrally with the first face, wherein the supporting part is formed integrally on the third face opposing the first face, wherein the second face and the fourth face communicate with the third face and include a supporting-part retaining rib for retaining a supporting part formed on the third face, wherein the fourth face communicates with the fifth face to retain the fifth face and includes a first spring contact part protection rib for protecting the spring contact part of the first face, and wherein the fifth face includes a second spring contact part protection rib for protecting the spring contact part formed on the first face, and wherein the fifth face comprises;

a bent area, further comprising;

an insertion/removal preventing part provided by bending one part of the bent area to form a perpendicular face to the bent area.

2. A connection terminal according to claim 1, wherein the holding part additionally includes a foreign matter prevention part for preventing foreign matter from entering into the spring contact part.

3. A connection terminal according to claim 1, wherein the holding part additionally includes a collision avoidance part for preventing collision of the spring contact part with an end part of the substrate when the substrate is inserted and fitted.

4. A connection terminal according to claim 1, wherein the fifth face includes a spring contact part protection face for protecting the spring contact part by partially bending the fifth face.

5. A connection terminal according to claim 1, wherein the first face comprises an approximately oval-shaped contact forming part and a curved part formed at a first end thereof, and a rigidity improved part formed at a second end thereof.

6. A connector which retains a connection terminal connecting an electric wiring with a substrate, the connector comprising;

a connection terminal comprising;

a crimping part which connects the electric wiring by gripping the conductor part of the electric wiring;

a holding part which holds the substrate between a supporting part and a spring contact part that energizes the conductor areas fixed on an end part of the substrate and also electrically connects these conductor areas and a box part having an approximately rectangular cross section which supports the holding part and electrically communicates with the crimping part; and a housing which retains the connection terminal;

wherein the box part comprises;

a first face, a second face, a third face, a fourth face, and a fifth face, all formed by bending a single sheet of a planar member;

wherein a back surface of the fifth face is superimposed on a surface of the first face, wherein an end part of the first face is engaged with an aperture formed at an interface between the bent part of the fourth face and that of the fifth face, wherein the spring contact part of the holding part is formed integrally with the first face, wherein the supporting part is formed integrally on the third face opposing the first face, wherein the second face and the fourth face communicate with the third face and include a supporting-part retaining rib for retaining a supporting part formed on the third face, wherein the fourth face communicates with the fifth face to retain the fifth face and includes a first spring contact part protection rib for protecting the spring contact part of the first face, and wherein the fifth face includes a second spring contact part protection rib for protecting the spring contact part formed on the first face, and wherein the fifth face comprises;

a bent area, further comprising;

an insertion/removal preventing part provided by bending one part of the bent area to form a perpendicular face to the bent area.

7. A connector according to claim 6, wherein the holding part additionally includes a foreign matter prevention part which prevents foreign matter from entering into the spring contact part.

8. A connector according to claim 6, wherein the holding part additionally includes a collision avoidance part for preventing collision of the spring contact part with an end part of the substrate when the substrate is inserted and fitted.

9. A connector according to claim 6, wherein the fifth face includes a spring contact part protection face for protecting the spring contact part by partially bending the fifth face.

10. A connector according to claim 6, wherein the first face comprises an approximately oval-shaped contact forming part and a curved part formed at a first end thereof, and a rigidity improved part formed at a second end thereof.

* * * * *